US011857053B2

(12) United States Patent
Johnson

(10) Patent No.: US 11,857,053 B2
(45) **Date of Patent: *Jan. 2, 2024**

(54) HAIR FREEDOM CUSTOMIZABLE TUNNEL SYSTEM, METHOD, DEVICE AND KIT

(71) Applicant: Alisa Ann Johnson, Middleburg, VA (US)

(72) Inventor: Alisa Ann Johnson, Middleburg, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/950,455

(22) Filed: Sep. 22, 2022

(65) Prior Publication Data

US 2023/0035115 A1 Feb. 2, 2023

Related U.S. Application Data

(63) Continuation of application No. 17/411,782, filed on Aug. 25, 2021, now Pat. No. 11,452,353.

(60) Provisional application No. 63/070,326, filed on Aug. 26, 2020.

(51) Int. Cl.

| | |
|---|---|
| ***A45D 20/24*** | (2006.01) |
| ***A45D 20/34*** | (2006.01) |
| ***A45D 20/32*** | (2006.01) |
| ***A45D 20/02*** | (2006.01) |

(52) U.S. Cl.

CPC ..... *A45D 20/24* (2013.01); *A45D 20/02* (2013.01); *A45D 20/32* (2013.01); *A45D 20/34* (2013.01)

(58) Field of Classification Search

CPC ..... A45D 20/24; A45D 20/02; A45D 20/32; A45D 20/34

See application file for complete search history.

(56) References Cited

U.S. PATENT DOCUMENTS

| | | | | |
|---|---|---|---|---|
| 1,514,495 A * | 11/1924 | Wirth | ..... | A45D 20/02 15/409 |
| 3,265,346 A * | 8/1966 | Petrick | ..... | A45D 20/32 403/104 |
| 3,822,483 A * | 7/1974 | Hubner | ..... | A45D 20/24 D28/12 |

(Continued)

FOREIGN PATENT DOCUMENTS

CN 109077425 A * 12/2018

OTHER PUBLICATIONS

English translation CN-109077425-A Chen (Year: 2018).*

(Continued)

*Primary Examiner* — Jessica Yuen

(74) *Attorney, Agent, or Firm* — Raymond Van Dyke; Van Dyke Intellectual Property Law

(57) ABSTRACT

The present invention is directed to an aid to help consumers with long hair to more efficiently and evenly dry their hair at one time. A system, device, technique and kit are envisioned that allow a consumer to either adapt existing hair drying equipment for this enhanced purpose or provide entirely new systems or kits to enable the consumer to evenly dry their hair. Extension members threadably engage to each other and a hair dryer or bonnet, the combined elements when mounted to or on a stand allow a user to control, adjust and guide the airflow around long hair of the user inserted into a tunnel portion of the extension members. A heat distribution conduit provides even heat to the deployed hair, and a stand or mount are employed to stabilize the assembly.

25 Claims, 6 Drawing Sheets

(56) References Cited

U.S. PATENT DOCUMENTS

| | | | | |
|---|---|---|---|---|
| 4,118,874 | A * | 10/1978 | Morane | A45D 20/34 34/100 |
| 6,301,800 | B1 * | 10/2001 | Standley | A45D 20/08 34/418 |
| 11,452,353 | B2 * | 9/2022 | Johnson | A45D 20/34 |

OTHER PUBLICATIONS

"Pibbs 515 Kwik Dryer With Wall Mount", Buy-Rite Salon and SPA equipment, dated Aug. 24, 2020, retrieved: https://www.buyritebeauty.com/pibbs-515-kwik-dryer-with-wall-mount (Year: 2020).*

* cited by examiner

HAIR FREEDOM CUSTOMIZABLE TUNNEL SYSTEM, METHOD, DEVICE AND KIT

RELATED APPLICATIONS

This application is a continuation of pending U.S. patent application Ser. No. 17/411,782, filed Aug. 25, 2021, now U.S. Pat. No. 11,452,353, which claims priority from Provisional Patent Application Ser. No. 63/070,326, filed Aug. 26, 2000, the subject matters of which are incorporated herein by reference.

FIELD OF THE INVENTION

The present invention is directed to improvements in techniques and equipment for effectively and efficiently drying hair, particularly long hair.

BACKGROUND OF INVENTION

People with long hair have long had problems maintaining their hair. For example, one such problem is evenly drying long hair. Beauty salons, which professionally handle hair, also have problems drying long hair, primarily since their equipment is configured for general hair use and styling methods, such as roller sets and blow-outs, as understood in this art, that do not address the needs of a growing base of consumers seeking a more natural look. People drying their own hair also have difficulty since despite their best efforts at drying their own hair, and the hair usually dries unevenly.

The hair dryer industry does not adequately address the needs of consumers with long hair who desire to dry their hair without interfering with the natural hair texture, and to dry the entire length of their hair at once instead of in segments, i.e., evenly.

To meet this need, professional beauty salons and hair establishments need a way to better meet the needs for long-haired customers, e.g., through modification and customization of existing equipment, and/or purchase of new equipment to meet these needs. Likewise, customers at home, handling their own hair, could use new equipment, configurations and techniques to fill this unmet need.

There is, therefore, a present and unmet need to provide a system, device, apparatus, methodology or kit to dry long hair evenly, and improve existing ways to dry long hair more efficiently and more in line with consumer demand.

SUMMARY OF THE PRESENT INVENTION

The present invention is directed to apparatuses and techniques to aid and help consumers with long hair to more efficiently dry their hair, particularly evenly at one time instead of in stages. A system, apparatus, device, technique and kit are envisioned that allow a consumer to either adapt existing professional or home hair drying equipment for this enhanced purpose or provide entirely new systems or kits to enable the consumer to better and evenly dry their own hair.

BRIEF DESCRIPTION OF THE DRAWINGS

While the specification concludes with claims particularly pointing out and distinctly claiming the subject matter that is regarded as forming the present invention, it is believed that the invention will be better understood from the following description taken in conjunction with the accompanying DRAWINGS, where like reference numerals designate like structural and other elements, in which:

DETAILED DESCRIPTION OF THE PRESENT INVENTION

The present invention will now be described more fully hereinafter with reference to the accompanying DRAWINGS, in which preferred embodiments of the invention are shown. It is, of course, understood that this invention may, however, be embodied in many different forms and should not be construed as limited to the embodiments set forth herein; rather, these embodiments are provided so that the disclosure will be thorough and complete, and will fully convey the scope of the invention to those skilled in the art. It is, therefore, to be understood that other embodiments can be utilized and structural changes can be made without departing from the scope of the present invention.

The present invention is generally directed to an improved system, apparatus, device, system, kit and technique for drying human hair, particularly for evenly drying difficult-to-dry long hair.

Figure 1:
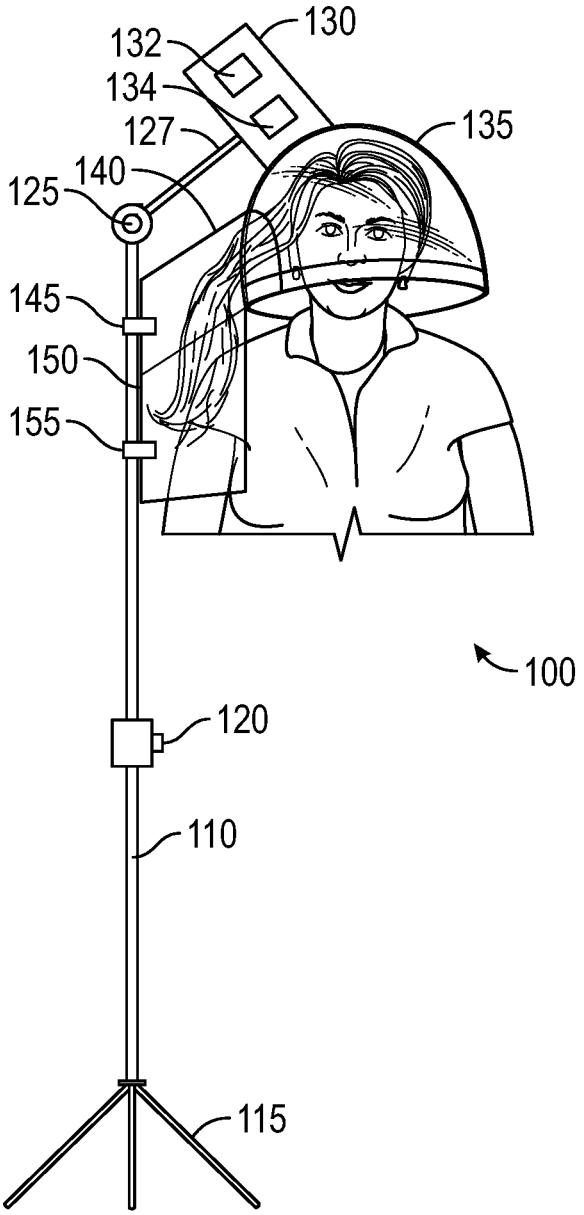
FIG. 1 is a representative view of a tunnel hair drying system or device employing the principles of the present invention in an exemplary configuration, showing the use of representative apparatuses with a user in their home.

With reference now to FIG. 1 of the DRAWINGS, there is illustrated a representative configuration of a first embodiment of an improved hair drying apparatus practicing the principles of the present invention and generally designated by the reference numeral 100, e.g., by a user in their own home.

As shown, the hair dryer configuration 100 has a stand, generally designated by the reference numeral 110, which is preferably comprised of a metallic material, as described in more detail hereinbelow. The reason for the stand 110 is to provide a measure of stability for the user operating the equipment as the user dries their hair. It should be understood that the user may be seated or standing, as per their preference in using the instant invention. The figure shown is only the torso for illustration. At one end of the stand 110 is a base portion, generally designated by the reference numeral 115, such as a plurality of stabilizing feet. It should, of course, be understood that alternate means to secure the configuration 100 are envisioned whether on the grounds or elsewhere, some of which are described in more detail hereinbelow.

It should be understood that the stand 110 should be adaptable to reflect the great variety of consumers. Accordingly, the height of the stand 110 is preferably adjustable, such as by using concentric cylindrical members, i.e., the stand has component slidable parts, which can be adjusted to either increase or decrease the height, e.g., using a spring or other trigger button, generally designated by the reference numeral 120, by which the height and position of the configuration 100 can be maintained, as is understood in the art. For example, the user may press the button 120 and arrange the stand components to their likeness, at which point the button 120 is released and the stand configuration or position is locked in place, as is understood in the art.

With further reference to FIG. 1, toward the other end of the stand 110 is an angular adjustment member, generally designated by the reference numeral 125, which can be easily manipulated to provide a variety of angles for attachments thereto, such as a blower described hereinbelow Thus, with the stand 110 height properly positioned for use with the user, the user, whether a hair dresser or the user alone at home, can tilt or otherwise adjust and modify the direction of the heated or unheated air flows, using the aforesaid angular adjustment member 125, focusing the heated or unheated air flow for optimal effect for long hair, which is an advantage of the present invention.

Of course, the hair dryer configuration 100 must have a blower, i.e., a device to drive heated or unheated air therethrough to dry the hair. It should be understood that further details about the airflow over the hair and the consistency of that flow are described in more detail across the many embodiments described in more detail herein, particularly regarding the even distribution of heat across the hair. An advantage of the instant invention is to provide adaptability of use, i.e., a user can modify an existing dryer, e.g., by using a kit described hereinbelow, or the blower and all attachments, including the stand, can be sold together, with the various components preconfigured to snap or otherwise connect together.

The technique for one use of the hair dryer configuration 100 pursuant to the present invention is straightforward. As illustrated, a conventional blower or customized motor housing or hair dryer apparatus or blower, generally designated by the reference numeral 130, is securely affixed to or near the aforementioned angular adjustment member 125, such that the position or direction of the exiting heated or unheated air from the blower or hair dryer 130 selected by the user. In the configuration 100, there is shown a blower connector, generally designated by the reference numeral 127, which connects the blower 130 to the angular adjustment member 125, which, as discussed, allows the user to adjust the position of the blower 130 vis-à-vis the long hair of the user.

It should be understood that the blower 130 is preferably made of a stainless steel or a hard plastic material capable of handling the heat of operation. Where a conventional or professional hair dryer device 130 is used, such as shown with other embodiments herein, the device can be used as is, i.e., independently store bought (not customized) to force the air.

In normal or conventional usage, a user would either manually manipulate the hair dryer 130 or perhaps affix or mount the dryer 130 to the stand 110 for stability, e.g., via the blower connector 127, and move their head around the streaming hot air, which does not evenly dry the hair.

It should be understood that the principles of the present invention can be employed in differing manners, as depicted in the various configurations illustrated and described herein. A first presently preferred configuration can be employed by users in varying circumstances, as depicted in FIG. 1.

Pursuant to the instant invention in this first embodiment, there is a hood or bonnet, generally designated by the reference numeral 135, configured to receive a human head just as in beauty parlors, which is illustrated in FIG. 1. As shown in this home embodiment, a home or other blower 130 attaches to the bonnet 135, preferably at or near the top thereof, with the heated or unheated blown air filling the bonnet 135 and drying the hair of the human shown in the Figure, more particularly, as described hereinbelow, the heated or unheated air is driven into a heat distribution system.

As discussed, further detail on the manner of dispersal of the heated or unheated air within the bonnet 135, as well as attachments thereto, are discussed hereinbelow.

Figure 1A:
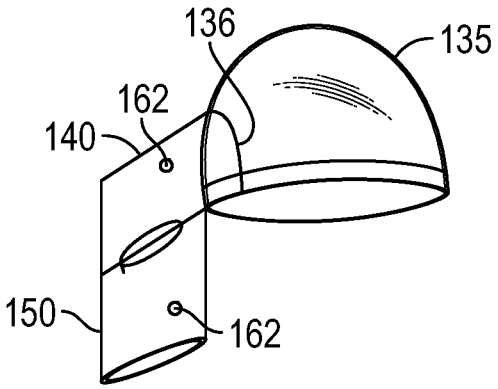
FIG. 1A is a representative view of particular components shown in FIG. 1, particularly the bonnet and two attachments or extenders pursuant to the teachings of the present invention.

Also shown are at least two tunnel dryer extension members, generally designated by the reference numerals 140 and 150, respectfully, which are sufficiently sized to both interlock to each other and connect to the bonnet 135, and receive the long hair of the user therein, as shown in the Figures, such as FIG. 1. Additional details for this interconnection are illustrated in FIG. 1A, which isolates the bonnet 135 and the tunnel dryer extenders 140 and 150.

As illustrated, the tunnel dryer extension 140 securely connects to the aforesaid bonnet 135, whether threadably or otherwise interlocking together for use, as well as easily disconnected after use. An end of the tunnel 140 thus securely attaches to a connection to the bonnet 135, particularly to an aperture or hole, generally designated by the reference numeral 136, into the bonnet 135, allowing a portion of the heated or unheated air from within the bonnet 135 to travel into the tunnel 140, and over any hair disposed therein.

As discussed further hereinbelow, in a preferred embodiment of the instant invention, the aforementioned aperture 136 would be behind the user depicted in FIG. 1, with the user's long hair extending symmetrically backwards, i.e., behind the user depicted.

With reference again to FIG. 1, the present invention can be employed with the aforesaid stand 110 to secure the configuration 100 thereto. Here, a clasp or other connector means, generally designated by the reference numeral 145, such as Velcro, securely connects the tunnel 140, along with the bonnet 135 attached thereto as described, to the stand 110.

It should be understood that the aforementioned blower connection 127 may not be necessary (for support) in addition to the supports provided by the clasp 145 and other clasps discussed further hereinbelow.

It should, of course, be understood that the present invention could comprise just one extension member 140, perhaps quite elongated to receive long hair, instead of two, but having two extension members allows greater flexibility to the user. It should also be understood that three or more extension members could also be employed, although more than two could become too difficult, cumbersome or problematic to operate.

For longer hair, a second tunnel dryer connector 150, as shown, threadably or otherwise connects to an underside of the aforesaid tunnel 140 and receives the heated or unheated blown air flowing from the bonnet and 135 and tunnel 140, with a possible connection on the other side thereof for perhaps a third tunnel or just otherwise open to allow the traversing air to exit or perhaps closed, as discussed further hereinbelow. As with the tunnel 140, tunnel 150 is attachable to a clasp, generally designated by the reference numeral 155, and the aforesaid stand 110, thereby further securing the entire configuration 100, providing a rather stable configuration for the user. Whereas in this embodiment, the passageway through tunnel 140 is somewhat curved to redirect the air and better dry the hair therein, the tunnel 150 is preferably substantially tubular, with the blown air passing through over the hair. As discussed in more detail hereinbelow, the blown air in a preferred embodiment is directed in a different manner to provide the even drying capability of the instant invention.

As shown in FIG. 1A, the tunnel extension members 140 and 150 may have ventilating holes, generally designated by the reference numeral 162, which would help control the internal temperatures within the extension members 140 and 150, and also protect the delicate long hair placed therein from temperature extremities.

In a preferred embodiment, each tunnel extension member 140 and 150 is about 8 inches in length and about 10 inches in diameter. It should, of course, be understood that alternate dimensions are possible and within the scope of the present invention, e.g., lengths from about 4 to about 12 inches for each extension member, preferably about 6 inches to about 10 inches, more preferably about 7 to about 9 inches, and most preferably 8 inches.

Diameter dimensions can vary also, e.g., from about 4 inches to about 16 inches, preferably about 6 inches to about 14 inches, more preferably about 8 inches to about 12 inches, and most preferably about 10 inches. The components should also be easily handled and easily connected and disconnected from each other, i.e., easily interlocked.

Also, each extension member 140 and 150 can be made of stainless steel or hard plastic, so long as the plastic is able to withstand the requisite heat from the motor housing or hair dryer 130. Further, the blower 130 can be powered by electricity, e.g., through a power cord or by use of batteries, as is understood in the art.

It should be understood that the hair dryer or blower 130 and the preferred two extension members 140 and 150 interlock to secure the entire configuration for use, as illustrated and described. For example, each of these components can have threads along the end portions thereof, whereby the respective components threadably interlock by rotating them in place, as described and illustrated in more detail hereinbelow. It should, of course, be understood that other secure (but preferably easily disconnected) interlocking mechanisms are contemplated, e.g., latches, springs and other means whereby the components can securely and conveniently interlock.

With reference again to FIG. 1, there is shown the configuration 100 in operation, i.e., the aforementioned user, whose long hair is deployed, as shown, within the extension members 140 and 150 shown with the components shown transparent for ease of illustration. The hair dryer 130 blows air through the bonnet 135 and the two extension members, and across the aforesaid long hair, drying same substantially uniformly from the tips to the roots, providing the benefits of the instant invention. For even drying, the heat should be evenly distributed and applied, such as through a venting means, as described in more detail hereinbelow. The advantages of drying all the hair at once are not just timesaving. For example, and as understood in this art, with textured hair, faster drying reduces shrinkage and leaves the hair smoother.

As discussed, it should be understood that in a preferred embodiment of the present invention, the aforesaid aperture or hole 136 in the bonnet 135 should be at the back of the bonnet 135 and not preferably at the side, as shown for convenience of explanation and illustration. Thus, for symmetrical drying of long hair, the aforesaid extenders 140 and 150 may instead project outwards behind the user. Thus, the position of the stand 110 would be modified to provide support in this preferred configuration.

Figure 2:
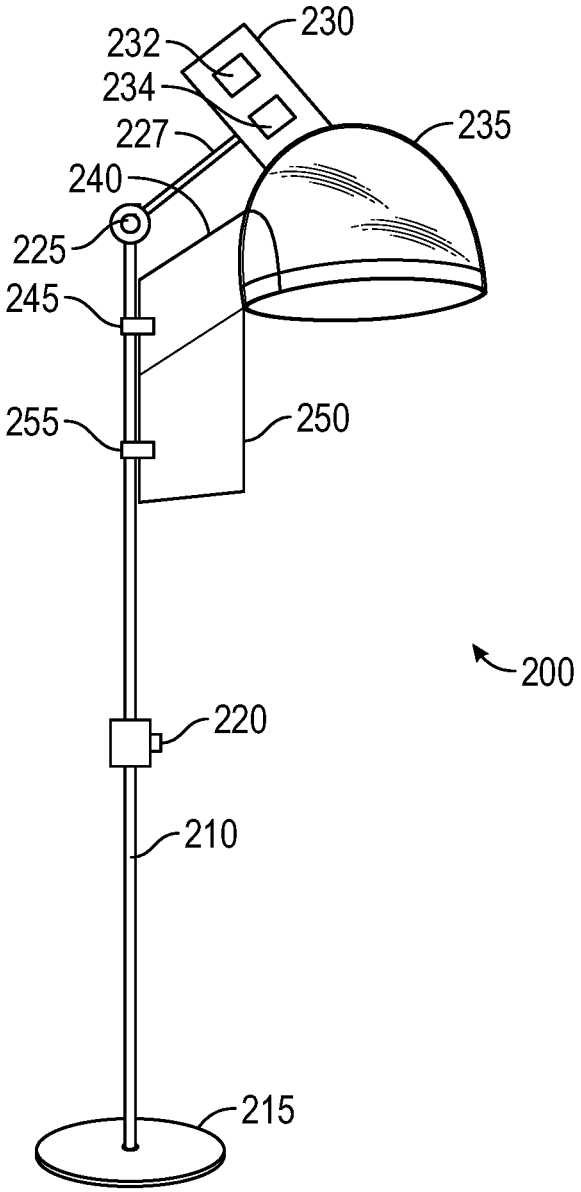
FIG. 2 is the tunnel hair drying system or device of FIG. 1 configured for use, but shown without the user.

With reference now to FIG. 2 of the DRAWINGS, there is illustrated a representative configuration of another improved hair drying apparatus for practicing the principles of the present invention, generally designated by the reference numeral 200, which resembles the configuration 100 of FIG. 1 but without the user depicted.

In this embodiment, a different stand is shown, generally designated by the reference numeral 210. Here the stand 210 has at one end a solid base member, generally designated by the reference numeral 215, which has sufficient weight to anchor the entire configuration securely for use, as illustrated. The stand 210 here also differs in that it has two or more members, each connected to the other by a screw or other mechanism, as is understood in the art, whereby the stand 210 can be broken down to manageable sizes for storage or transport, e.g., shipping, as illustrated and described in more detail in connection with FIG. 5.

It should, of course, be understood that the user or consumer would want to adjust and control the temperature of the blown air, e.g., through the use of a control switch, generally designated by the reference numeral 132/232 in FIGS. 1 and 2. A user can thus adjust the air temperature flowing onto and over their hair from unheated to medium heat to high heat, and intermediate levels therebetween, using the control switch 132/232, i.e., the switch can have these settings, along with off, or the switch can be more analog, with settings of off and max with perhaps markings therebetween.

Furthermore, the user may also want to control or adjust the amount of the air flow, e.g., through the use of a flow switch, generally designated by the reference numeral 134/234 also shown in FIGS. 1 and 2. A user can thus adjust the airflow onto and over heir hair from low to medium to high, and intermediate levels therebetween, using the flow switch 134/234, which, as described hereinabove, could also be an analog implementation.

Figure 3:
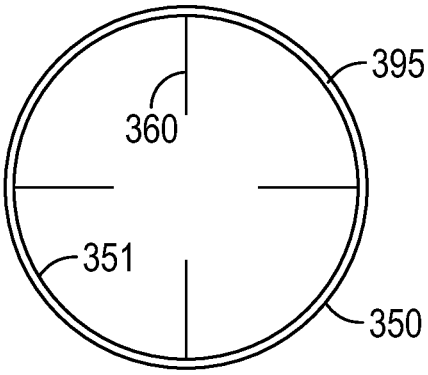
FIG. 3 is a cross-sectional view of an extension member of FIGS. 1 and 2 in an alternate exemplary embodiment, generally illustrating features of the heat distribution system.

With reference now to FIG. 3 of the DRAWINGS, there is illustrated a cross-sectional view of the aforementioned extension members in an alternate embodiment of the present invention, showing a plurality of air flow channelers, generally designated by the reference numeral 360 within an exemplary extension member 350. It should be understood that the aforementioned extension members 140/240 and 150/250 can screw on and off, with the aforementioned air flow channelers 360 therein preferably lining up.

Also shown is an inner heat distribution means, generally designated by the reference numeral 395, which is described in more detail hereinbelow in connection with FIG. 7.

By virtue of the inner heat distribution system or means 395, all of the hair, i.e., from the scalp of the user in the bonnet 335 to the tips of their hair in connector 350 have the same or substantially the same heat exposure. The blown air, however, as described, also traverses the passages or airways unless blocked.

In addition to the air flow channelers 360 serving as blown air directors for the ambient air within the passageways, the structure of the channelers 360 can be deployed to better secure the long hair in place during the operation of the configurations, e.g., the ends of the hair may be secured to prevent the blowback of the hair. The shape of these channelers 360 can thus be contoured to better capture the hair in the respective tunnel extension members 140/240 and 150/250, where the hair is thicker in the extension member 140/240 closest the scalp of the user and thinner in the second or further tunnel extension member 150/250 in this embodiment. It should be understood that these factors may differ with the differing use.

Figure 4:
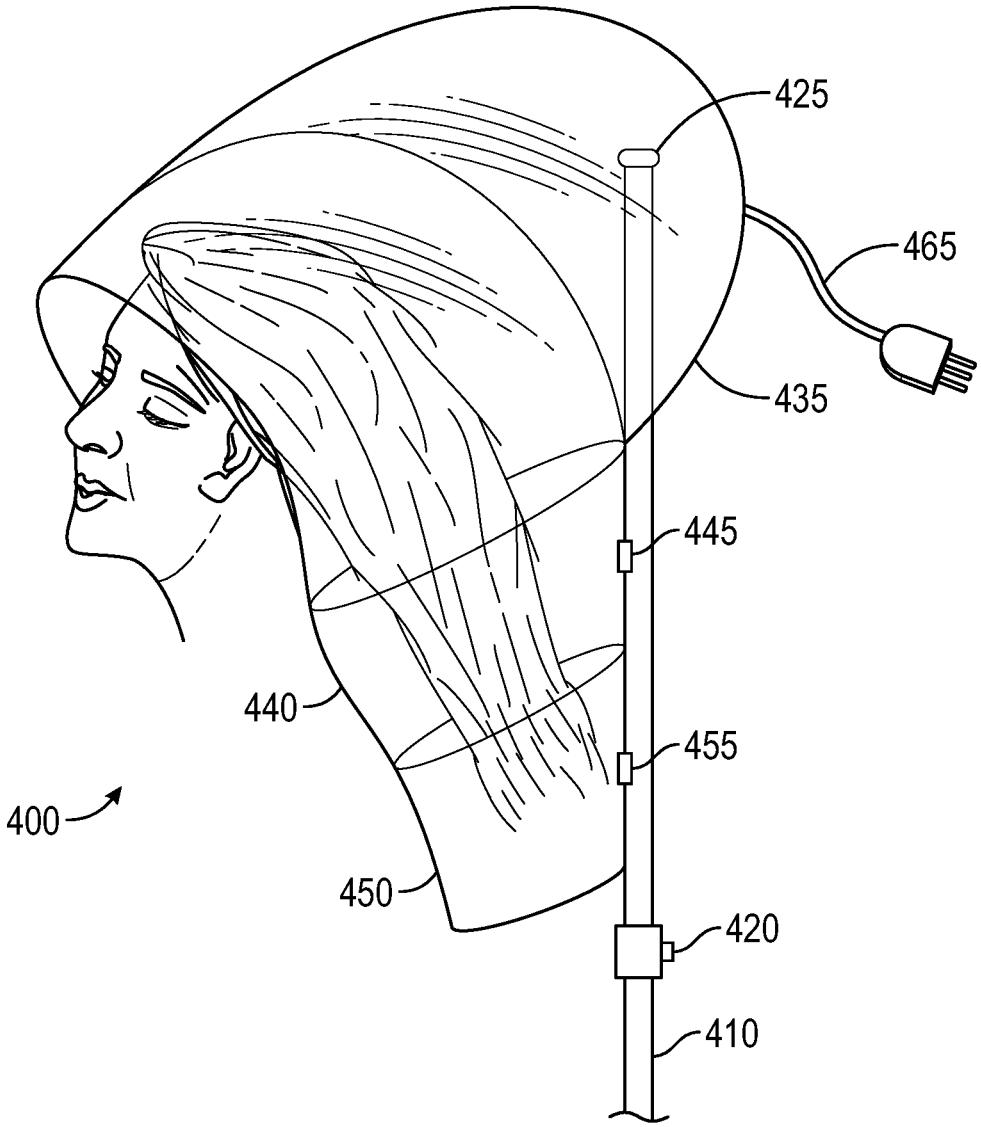
FIG. 4 is a representative view of another tunnel hair drying apparatus employing the principles of the present invention in another exemplary configuration, showing the use of representative interlocking components in connection with a user in a salon.

With reference now to FIG. 4 of the DRAWINGS, there is illustrated another representative configuration of the presently preferred embodiment of an improved hair drying apparatus practicing the principles of the present invention and generally designated by the reference numeral 400, such as may be employed in a beauty salon or other establishment in another embodiment.

As with the other embodiments, there is a stand 410 (partially shown), with a height adjuster 420 and an angle adjuster 425, and a bonnet 435, which can be a professional-style bonnet, as found in hair salons or even a portable bonnet, such as may be used by users in their own home. It should be understood that the hood or bonnet 435 in this embodiment generates the blown air, i.e., the blown air is not generated externally, such as by the blower 130 in FIG. 1.

The bonnet 435 in this embodiment is powered by electricity through a plug and cord, generally designated by the reference numeral 465. It should, of course, be understood that, as with the other hair dryer or blower embodiments hereinabove, the devices 135/235/435 may instead be powered by batteries disposed within the devices or attachments thereto, as needed.

As shown, a user, perhaps sitting in a chair adjacent the configuration 400 attached to a stand, inserts their head into the bonnet 435, as in conventional devices in hair or beauty salons. Unlike salons, however, the present invention offers an improved air-drying technique not known in the prior art, i.e., the extension members with the drying tunnels for the long hair of the user, with simultaneous or substantially simultaneous drying by the aforesaid heat distribution system described hereinabove and hereinbelow.

In this embodiment, the extenders 440 and 450 connect to the bonnet 435, such as threadably or via springs, as described hereinabove, and the hair is disposed into the tunnel extenders 440 and 450, as shown. It should be understood that the bonnet 435 and extension members 440 and 450 are portrayed in FIG. 4 as transparent in an aid to better describe the invention, but, of course, need not be so in products. It should, therefore, be understood that the blown airflow generated by the motors in the bonnet 435, just as those created by the blower 130, moves the air therein, helping to dry the user's hair within the bonnet 435, i.e., near the scalp, and in escaping the bonnet 435, the heated or unheated airflow flows through the extension members 440 and 450 in turn and across the hair deployed therein, evenly drying it, particularly by virtue of the heat distribution conduits of the instant invention.

With further reference to FIG. 4, there is again shown the stability aspect of the present invention, which provides more stability, such as with portable usages within the home or even within a salon. With the potential ungainliness of the configuration, e.g., the bonnet 435 with the two extension members 440 and 450, as well as the earlier like configurations, the bonnet 435 and the extension members 440 and 450 are preferably secured to the stand 410, which provides the requisite stability. Other means for stabilizing are, however, contemplated.

In any event, extension member 440 is threadably or otherwise secured to the bonnet 435, as described. The extension member 440 is also and separately secured to the stand 410, such as via a clasp or connection, such as Velcro, generally designated by the reference numeral 445.

Likewise, extension member 450 is threadably or otherwise secured to the first extension member 440, as shown, and also secured to the stand 410, such as via another clasp or connection, generally designated by the reference numeral 455. In this manner, the user can comfortably sit or otherwise rest while the configuration of the instant invention, secured in place, dries the full length of their hair with a safe and stable configuration.

As described, the user in positioning themselves for the operation of the invention, would likely be seated and the stand 110/210/410 adjusted, as described, to best position the components vis-à-vis themselves and in a comfortable manner. In operation, the user could position themselves and secure the bonnet 435 over their head in a conventional manner, as shown. The user could then move their hair into and through one or both of the aforesaid extension members 440 and 450 already secured to the bonnet 435, as described. Of course, the user could instead move their long hair through the aforesaid hole in the bonnet 435 (shown as hole 536 in FIG. 5), i.e., with the first extension member 440 not secured thereto, then deploy their hair through the first extension member 440, and then secure the first extension member 440 to the bonnet 435 as described, covering the hole; likewise with the second extension member 450.

Figure 5:
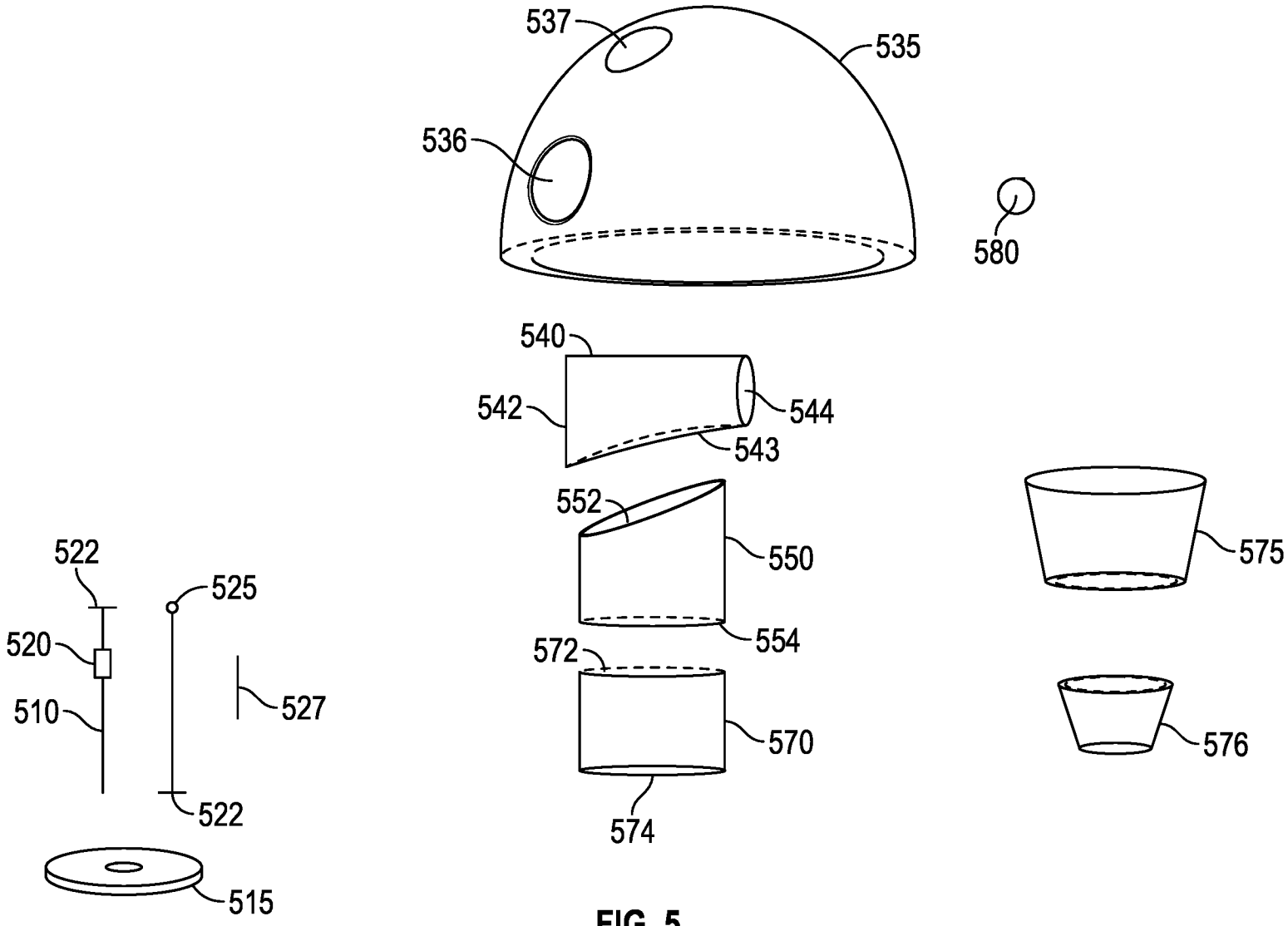
FIG. 5 is a depiction of a kit, such as constituting the disassembled components of all or part of the configurations of FIGS. 1, 2 and 4.

With reference now to FIG. 5 of the DRAWINGS, there is illustrated the various components of the embodiments described hereinabove disassembled and in a kit format, generally designated by the reference numeral 500, and perhaps all fitting within a bag or a box for convenience, e.g., a segmented stand 510, such as stand 210 (not shown to scale), and a base 515, where the disassembled stand component threadably or otherwise securely combine.

As mentioned hereinabove, the stand 510 could be in two or more pieces or components that threadably connect, such as at a juncture, generally designated by the reference numeral 522, whereby the full stand is thus assembled. Also shown is the aforesaid blower connection 527, which connects to the angle adjuster 525, as described hereinabove.

The kit 500 also includes a hair dryer or motor housing 530 and simple bonnet 535 for the home, or a powered bonnet 535, such as with beauty parlors. In other words, the bonnet 535 could be a professional device with the blower capability therein or the kit 500 could alternatively or also include a blower 130.

The kit 500 further includes at least two extension members 540 and 550 to handle most long hair. It should be understood that the stand 510 may instead fold instead of disassemble.

As further shown in FIG. 5, each of the aforementioned hair dryer or bonnet 535 and the two extension members 540 and 550 have respective threaded portions, e.g., threads within an opening 536 in the bonnet 535, at an end 544 and a side portion 543 of the extension member 540, and at an end 552 of the extension member 550, respectively, by which the components can threadably interlock together, as illustrated and described in more detail hereinabove. Similarly, the aforementioned blower 130 can, at the air exit end, have threads that threadably engage the blower to the hood or bonnet 535, e.g., at a hole 537, whereby the blower 130 can be securely attached to the configuration for use.

As also shown in FIG. 5, it should be understood that the extension members may taper or otherwise not be cylindrical in shape, as also shown in the embodiment of FIG. 4. Thus, an alternate first extension member, generally designated by the reference numeral 575, connects at one end to the aforesaid hole 536 in the bonnet 535, e.g., via threadable connections. The other end of the first extension member 575 is smaller, i.e., the diameter tapers. The second extension member in this embodiment, generally designated by the reference numeral 576, is sized at one end to threadably engage threads of the first extension member 575 in this embodiment, forming a tapering configuration. It should, of course, be understood that alternate configurations and shapes are contemplated.

As discussed, very long hair may demand larger or more extenders, and the kit 500 preferably includes another such extender, generally designated by the reference numeral 570, which may be longer than or shorter than the extender 550. Thus, through threaded or other connections, an end 554 of the second extender 550 can threadably engage an end 572 of the third extender 570. Likewise, further extenders, if necessary, can engage at end 574 of the third extender 570.

It should be understood that the aforesaid kit 500, although configured for a home use, can also work in a professional beauty salon or other establishment. In other words, the bonnet 535 could be a traditional professional one, i.e., powered. To convert the present invention for this other use, for use in either the home or the salon in a traditional manner, a simple plug, generally designated by the reference numeral 580, can be included in the kit 500, whereby simply closing the aforesaid opening 536 for the extender 540 transforms the instant invention for standard operations. In other words, by using a solid, slide or clip-on attachment or plug 580, which engages with the aforesaid opening 536 at the bottom of the hood or bonnet 535, the airflow to the tunnel extenders 540 and 550 is cut off (since the extenders are not connected), whereby the bonnet 535 would then act as a regular bonnet dryer, providing a degree of versatility in using the invention.

Similarly, the airflow through the tunnels can be interrupted by manipulation at the end of the aforesaid extenders 540 and 550. For example, an additional shallow, perhaps bol-shaped, twist-on attachment with no air holes, e.g., a plug 580, as described but configured for this use, can be used to close off the bottom or exit portion of the tunnel, e.g., at the terminus of the extender 550 shown, such as employing a plug 580 as described but configured to fit, e.g., threadably engaging at end 554. An advantage here is that the user may want increased air turbulence inside the tunnel as opposed to streamlined airflows.

Figure 6:
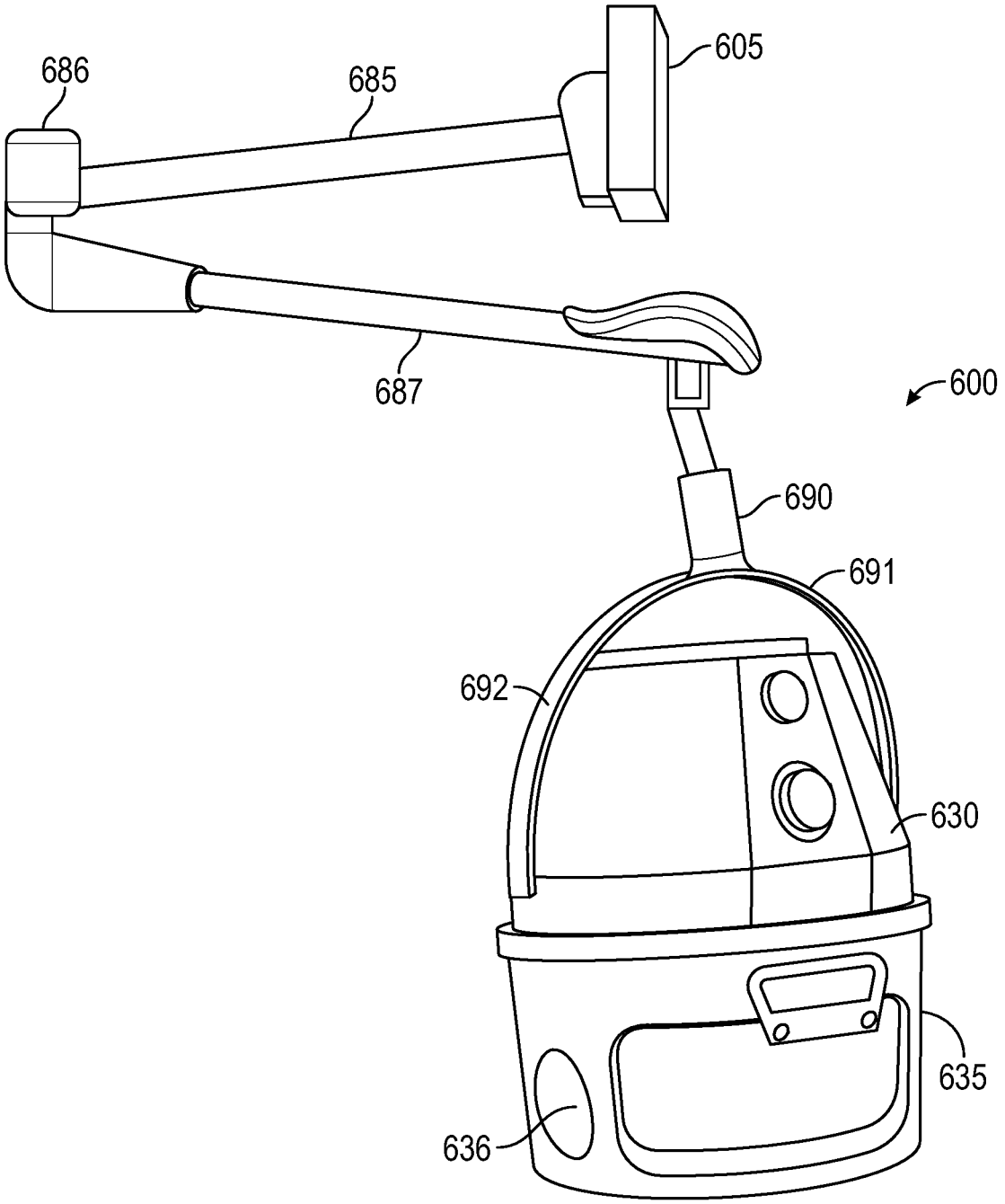
FIG. 6 is a representative view of a system or device for use in connection with and employing the principles of the present invention in a another exemplary and presently preferred configuration, such as may be used in a salon or at home.

With reference now to FIG. 6 of the DRAWINGS, there is illustrated an alternate configuration for the hood or bonnet, the embodiment generally designated by the reference numeral 600. Whereas the previous embodiments, e.g., FIGS. 1, 2 and 4, show the use of a stand 110/210/410 to provide support, the instant invention embodiment 600 has a different support configuration, i.e., it is wall or ceiling mounted.

As shown, the embodiment 600 has a mounting plate or securement means, generally designated by the reference numeral 605, which is firmly securable to a surface, for example, using screws, nails and other securement means to bolt the configuration 600 to the ceiling. The embodiment has a first arm, generally designated by the reference numeral 685, and is connected to the aforesaid mounting plate 605 at one end thereof. At the other end of the first arm 685 is a swivel connector, generally designated by the reference numeral 686, through which a wide range of arm motions become possible, such as in positioning the apparatus for use. A second arm, generally designated by the reference numeral 687, is connected to the aforesaid swivel connector 686 at one end and at the other end to a cradle, generally designated by the reference numeral 690. The second arm 687 has preferably has a wide range of motions and positions. It should also be understood that the configuration 600, once in position, has the means to stay in the configured position, i.e., the user positions the components and just has to let go, where the components stay in that configuration.

As shown in FIG. 6, the cradle 690 has respective arms, generally designated by the reference numerals 691 and 692, respectively, that straddle a hood or bonnet 635, and connect thereto along either side, e.g., through clamps or other mechanisms. In this more professionally-configured system, there is a blower portion, generally designated by the reference numeral 630, atop the bonnet 635. As such, the aforementioned clamps 691 and 692 can instead connect to the blower part 630, as shown. Also shown is a connector hole 636 to connect to the aforementioned tunnel extenders described hereinabove, e.g., threadably. In use, the user, usually seated, positions the bonnet 635 over their head, e.g., guiding the apparatus easily with their hands. The user then connects the first extender 540 and deploys their hair therethrough, and does the same with the second extender 550. Once the hair is deployed, the user turns the device on, e.g., using a switch on the blower portion 630, and the hair drying commences.

As discussed, the present invention is directed to techniques to evenly dry long hair, such as deployed in the bonnets and extenders shown hereinabove in connection with the various embodiments. As another and preferred embodiment feature for use in all of these embodiments, Applicant wishes to point out that for even drying it is best to evenly distribute air and heat, if heat I used, to all of the hair at the same time. Since the air, heated 5 or otherwise, is generated by a blower, that blown air must be dispersed across the bonnets and extenders simultaneously or substantially simultaneously, e.g., using the aforementioned inner heat distribution system or means 395, generally described hereinabove. Further details of this preferred technique are set forth hereinbelow.

It should be understood throughout the embodiments described that all references to heated or unheated air are made with the understanding that the user may choose to use the blower or dryer with unheated air throughout the drying process or may begin drying with heated air and turn the heat down or off as the hair dries.

Figure 7:
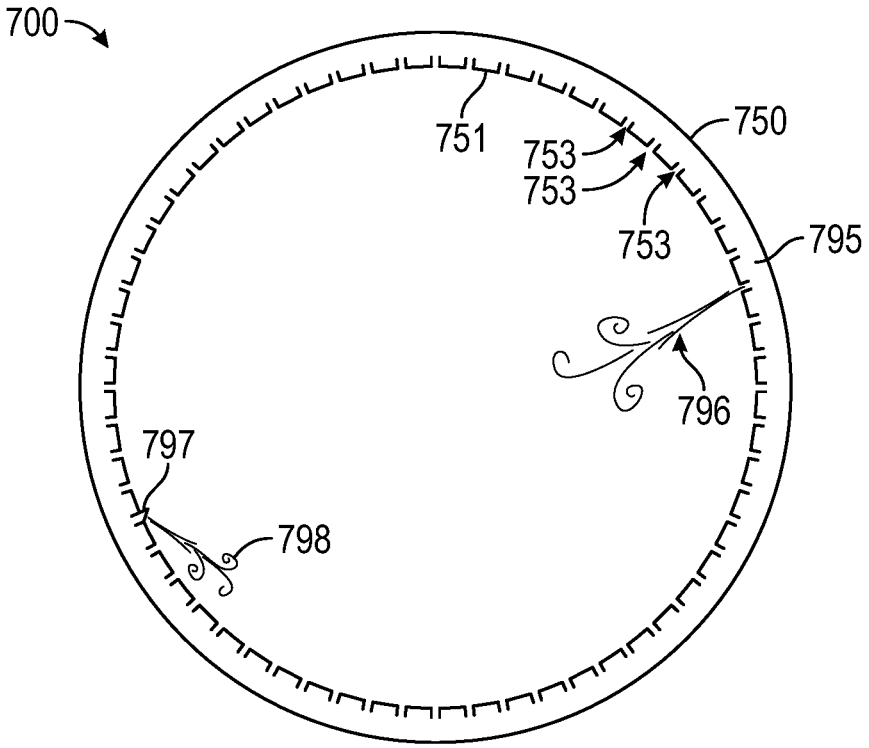
FIG. 7 is a more detailed cross-sectional view of the extension member of FIG. 3 in an alternate exemplary embodiment, illustrating a representation of a heat distribution system or conduits for employing the even heating feature of the present invention, where the interconnecting conduits distribute the heat evenly among the interconnected components shown herein.

With reference now to FIG. 7 of the DRAWINGS, there is illustrated the aforementioned cross-sectional view of an extension member, such as extension member 350 depicted in FIG. 3, which is substantially tubular as shown. The aforesaid air flow channelers 360 in this embodiment are omitted here for simplicity. As also shown in FIG. 3, the extension member 350/750 has an inner diameter, generally designated by the reference numeral 351/751, which connects to the heat distribution system or conduits.

With further reference to FIG. 7, the inner diameter 751 is perforated throughout with a large number of discrete air holes, each generally designated by the reference numeral 753, through which the heated or unheated air from the blower is ejected, i.e., there is a conduit or passageway from the blower and connected here. A representative spout of such ejected heated or unheated air being generally designated by the reference numeral 796, but identical such spouts 796 occur all along the circumference of the inner diameter 751, indeed all along the entire interior surface of the extension member 750, thereby evenly distributing the heat, not along the circumference shown but also along the entire inner surface of the connector 750, which is so constructed, evenly distributing the heat and air.

It should be understood that the heated or unheated air conduit 395/795 seamlessly connects to similar conduits configured within the first extender 340, and, in turn, to like conduits within the bonnet 335. In other words, all of the interior surfaces of the extenders and the bonnet have these conduits with the aforesaid pinpricks or holes 753 to disperse the heated or unheated blown air. Thus, the inner heat distribution means 395/795 also comprises like air holes 753 along all surfaces of the first extender 340, and the interlocking connectivity between the first and second extenders 340 and 350, as discussed, not only aligns the channelers 360 but also the respective portions of the heat distribution means 395/795. Likewise, the interior of the bonnet 335 substantially consists of a semispherical shape with the aforesaid holes 753 distributed evenly thereabout that surface, with the connectivity of the heat distribution means 395 of the bonnet connecting to the first (and second) extenders, as discussed, e.g., the aforesaid interlocking also interlocks the conduits.

It should be understood that the aforesaid blower 130/230 injects the heated or unheated air directly into the heat distribution system or means 395/795, and through the use of many discrete air holes 753 distributed all along the interior surfaces around the hair, the heat and the air flow would be distributed as evenly as possible, thereby satisfying the unmet need in the art.

Figure 8:
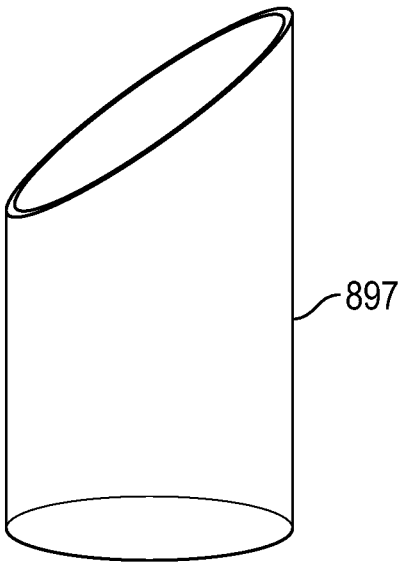
FIG. 8 is a representative angled airflow director that can be deployed within one or more airholes within the heat distribution system or conduit shown in FIG. 7

To further control the injection of the heated or unheated air from the heat distribution conduits 395, a number of the air holes 753 may be directed, i.e., they are not merely uniform holes, but instead include an angular director for guiding respective the air flows. With reference now to FIG. 8 of the DRAWINGS, there is shown an exemplary configuration for insertion into a number of the air holes 753, i.e., an angled director generally designated by the reference numeral 897, creating an angled air hole, such as generally designated by the reference numeral 797 and depicted in FIG. 7, along with a deflected, i.e., non-perpendicular, air spout therefrom, generally designated by the reference numeral 798. In this fashion, i.e, through the use of a number of these angled directors 897 in respective holes 753, the directed heat can be manipulated for particular uses.

As discussed, the heat distribution system and conduits 395/795 shown interconnect to disperse the heat evenly. The terminal conduit, of course, should be closed. Thu, a plug 580 or like connector would seal off the conduits, thereby preventing bleed off of the heated or unheated air. Thus, in the configuration 100 shown in FIG. 1, a plug 580 would attach to the terminal end of the second extender 150, more particularly, the plug 580 would threadably or otherwise secure to the end part 554 of the second extender 550 (of FIG. 5), thereby plugging the leak in the conduit system.

It should also be understood that that the aforesaid air holes or perforations 753 along the internal conduit surfaces could be uniform or otherwise configured, e.g., to maximize or equalize heat distribution. Further, with the use of the aforesaid angled directors 897, finer degrees of control of the heat distribution can be obtained.

It should be understood that one preferred configuration is that the components be in stainless steel, i.e., all of the components are made of stainless steel for aesthetics. Although more expensive and heavier, many consumers would prefer this configuration over plastic or other materials, which could degrade over time due to the heat.

It should be understood that in all of the configurations described and depicted herein, the extension members are easily detachable and cleanable, e.g., using a dish washer to remove the oils or residues from leave-in hair products.

The previous descriptions are of preferred embodiments for implementing the invention, and the scope of the invention should not necessarily be limited by these descriptions. It should be understood that all articles, references and citations recited herein are expressly incorporated by reference in their entirety. The scope of the current invention is defined by the following claims.

What is claimed is:

1. A hair drying system comprising:

a bonnet configured to receive a user having hair, said bonnet having at least one hole therethrough;

at least one extension member, said at least one extension member connected to said bonnet at said at least one hole, said at least one extension member extending therefrom and having a diameter configured to receive therein said hair of said user; and a heat distribution conduit, said heat distribution conduit distributing heated or unheated air across said bonnet and said at least one extension member through respective interconnected conduits within said bonnet and said at least one extension member, whereby the hair of a user deployed within said bonnet and said at least one extension member is evenly dried.

2. The hair drying system according to claim 1, wherein said bonnet and a blower, connected thereto, interlock, said blower injecting said heated or unheated air into a heat distribution conduit within said bonnet.

3. The hair drying system according to claim 1, wherein said bonnet and said at least one extension member interlock, wherein heat distribution conduits within said bonnet and within said at least one extension member align, whereby said heated or unheated air is distributed to said at least one extension member.

4. The hair drying system according to claim 1, wherein said at least one extension member comprises two extension members.

5. The hair drying system according to claim 4, wherein said two extension members interlock, whereby heat distribution conduits within said two extension members align, whereby said heated or unheated air is distributed to said two extension members.

6. The hair drying system according to claim 4, wherein a first extension member attached to said bonnet has a tapered diameter, and a second extension member attached to said first extension member has a tapered diameter, the diameter of said first extension member being greater than the diameter of said second extension member.

7. The hair drying system according to claim 1, wherein at least one of said bonnet and said at least one extension member is made from a plastic material.

8. The hair drying system according to claim 1, wherein at least one of said bonnet and said at least one extension member is made from stainless steel.

9. The hair drying system according to claim 1, wherein at least one of a blower, bonnet and said at least one extension member include threads configured for threaded engagement.

10. The hair drying system according to claim 1, wherein said heat distribution conduit comprises a bonnet conduit in said bonnet and at least one extension member conduit in said at least one extension member, said bonnet conduit and said at least one extension member conduit interconnecting upon interlocking the bonnet and said at least one extension member, whereby said heated or unheated air is distributed to said bonnet conduit and said at least one extension member conduit.

11. The hair drying system according to claim 1, wherein said heat distribution conduit comprises a plurality of perforations, whereby said heated or unheated air escapes through said perforations and dries said hair.

12. The hair drying system according to claim 11, further comprising:

a plug, said plug configured to attach to a terminal end of said at least one extension member, whereby said heat distribution conduit is closed, allowing all of said heated or unheated air therein to escape through said plurality of perforations.

13. The hair drying system according to claim 11, wherein at least one of said perforations includes an angled director therein, said angled director directing the heated or unheated air.

14. The hair drying system according to claim 1, further comprising:

a stand, said stand configured to connect to said bonnet and said at least one extension member, whereby said bonnet and said at least one extension member are secured to said stand by a plurality of clasps during operation of said hair drying system.

15. The hair drying system according to claim 14, further comprising:

a height adjuster, whereby the user can adjust the height of the stand.

16. The hair drying system according to claim 14, further comprising:

an angle adjuster, said angle adjuster at one end of said stand and connected to a blower, whereby the user can adjust the angle of the blower.

17. The hair drying system according to claim 1, further comprising:

a mount, said mount connected to a wall or ceiling;

at least one arm connected to said mount at one end and to said bonnet at another end.

18. The hair drying system according to claim 17, wherein said at least one arm comprises two arms, a first arm connected to said mount at one end and to a swivel at another end, and a second arm connected at one end to said swivel and at another end to said bonnet, whereby the user can adjust the position of the bonnet.

19. The hair drying system according to claim 1, further comprising:

a blower, said blower ejecting said heated or unheated air into said heat distribution conduit.

20. The hair drying system according to claim 19, wherein said blower and said bonnet being one device.

21. A kit for a hair drying system comprising:

a bonnet, said bonnet configured on kit assembly to receive therein a user having hair, said bonnet having at least one hole therethrough, and said bonnet configured to attach to a stand or mount;

at least one extension member, said at least one extension member connected at one end to said bonnet at said at least one hole, said at least one extension member extending therefrom and having a diameter configured to receive therein said hair of said user; and an air distribution conduit, said air distribution conduit distributing heated or unheated air across said bonnet and said at least one extension member through respective interconnected conduits within said bonnet and said at least one extension member, whereby, when assembled and in operation, the hair of a user deployed within said bonnet and said at least one extension member is evenly dried.

22. The kit for a hair drying system according to claim 21, further comprising:

a plug, said plug configured to attach to said bonnet at said at least one hole, whereby the bonnet can be used in a traditional manner.

23. The kit for a hair drying system according to claim 21, further comprising:

a blower, said blower ejecting said heated or unheated air into said heat distribution conduit.

24. The kit for a hair drying system according to claim 21, further comprising:

a plurality of components configured to assemble into said stand or mount, wherein said plurality of components are selected from the group consisting of extension members, variable-length extension members, tapered extension members, a stand, a segmented stand, a base, a blower, a hair dryer, a plug, a clasp, a mount, a mount with a plurality of arms, and combinations thereof.

25. A method for hair drying comprising:

connecting a hair bonnet to a stand or mount and secured thereto, connecting said hair bonnet to at least one extension member, said bonnet having at least one hole therethrough, said at least one extension member connected to said hair bonnet at said at least one hole, said at least one extension member extending therefrom and having a diameter configured to receive therein hair of a user, said bonnet and said at least one extension member, upon connection, forming a heat distribution conduit to distribute heated or unheated air from said hair bonnet through respective interconnected conduits within said hair bonnet and said at least one extension member; and connecting a blower to said hair bonnet, said blower ejecting said heated or unheated gas into said heat distribution conduit, said heat distribution conduit distributing said heated or unheated air across said hair bonnet and said at least one extension member, whereby hair of a user, whose head is in said bonnet and a portion of hair of said user is disposed in said at least one extension member, is dried.

* * * * *